US006185753B1

(12) United States Patent
Arai

(10) Patent No.: US 6,185,753 B1
(45) Date of Patent: Feb. 13, 2001

(54) FULL-FACE TYPE HELMET

(76) Inventor: Michio Arai, c/o Arai Helmet, Ltd., 12, Azuma-cho 2-chome, Ohmiya-shi, Saitama-ken (JP)

( * ) Notice: Under 35 U.S.C. 154(b), the term of this patent shall be extended for 0 days.

(21) Appl. No.: 09/227,143

(22) Filed: Jan. 8, 1999

(30) Foreign Application Priority Data

Jun. 23, 1998 (JP) ..... 10-176091

(51) Int. Cl.[7] ..... A42B 3/10
(52) U.S. Cl. ..... 2/414; 2/424
(58) Field of Search ..... 2/410, 411, 414, 2/421, 424, 425

(56) References Cited

U.S. PATENT DOCUMENTS 4,282,610 * 8/1981 Steigerwald et al. ..... 2/414
4,916,759 * 4/1990 Arai ..... 2/414
5,088,129 * 2/1992 Kamata ..... 2/411

FOREIGN PATENT DOCUMENTS

341781 * 1/1998 (TW) .

* cited by examiner

*Primary Examiner*—Michael A. Neas
(74) *Attorney, Agent, or Firm*—Dykema Gossett PLLC

(57) ABSTRACT

A full-face type helmet in which the breath of a person wearing the helmet and accumulated between the person (user) and the inner surface of the shell and flowed toward both right and left cheek pads is guided efficiently from the lower portion of the helmet in a slant rearward direction and released out of the helmet without reducing an original holding function of the cheek pads in contributing to good helmet fit. The user's breath is not accumulated in the helmet space at the front area of the face of helmet wearing person. A guide passage for releasing the breath of the user reflected by the chin guard arranged inside the shell and accumulated between the user and the inner surface of the shell from the lower part of the shell in a slant rearward direction is formed by crushing and deforming the intermediate part of the cushion member constituting the installing members in its thickness direction or by cutting the cushion member without reducing the abutted area with the cheeks at the cheek installing members and the cheek holding function.

4 Claims, 7 Drawing Sheets

FULL-FACE TYPE HELMET

BACKGROUND OF THE INVENTION

1. Field of the Invention

This invention relates to a full-face type helmet for protecting the head or the face of a user when riding on various kinds of motorized vehicles such as motorcycles and automobiles, and more particularly to the cheek installing members (the cheek pad) to be installed inside the helmet shell.

2. Description of the Prior Art

A comfortable fit of a full-face type helmet in which the head of a user is fully covered is maintained by a repelling action of a shock absorbing liner made of expanded polystyrene foam fitted to and arranged inside the shell and a cushion member made of urethane material adhered to and fixed to the inner side of the shock absorbing liner at the location corresponding to the head of the drivers or a location ranging from the ears to the cheeks and the chin. In particular, the cushions arranged at both right and left sides of the shell for pressing at the location ranging from the cheeks to the chin, i.e., the cheek pads, contribute to a fitting of the full-face type helmet.

However, since this full-face type helmet is formed with an integral chin guard at the lower front portion of the shell and the liner made of expanded polystyrene foam is fixed to an inner side of the chin guard, the breath (hot air) of a user is reflected against the liner arranged at the chin guard and directed against the front ends of the cheek pads arranged at both right and left sides near the mouth root portion of the user, resulting in hot air lost in the releasing path being accumulated between the chin guard and the face of the user.

A situation may develop in which the hot air lost in releasing path in the helmet is moved upward to collect as moisture in the shield.

SUMMARY OF THE INVENTION

As a means for preventing the breath of the helmet wearing person (user) from being accumulated in a space at the front part of his face within the helmet, it is satisfactory to guide the breath of the user reflected against the chin guard, accumulated between the user and the inner surface of the shell and directed to both right and left cheek pads out of the helmet, wherein as its method, the front side of the cushion member of the cheek portions arranged at both right and left sides in the shell can be reduced in size and cut and the cheek installing members (the cheek pads) pressing the chin part so as to prevent the reflected breath from being directed against the cheek installing members (the cheek pads). That is, the area of the cushion member abutted against the cheeks and the chin is reduced.

However, there may also be considered that the original function of the cheek pads for supporting the chin part is damaged and the wearing comfortable feeling of the helmet is reduced and when the front side of the cushion member at the cheek pads is cut and the area of the cushion member abutted against the cheek portions and the chin portion is reduced.

The present invention is completed in reference to the aforesaid problems found in the prior art and it is an object of the present invention to provide a full-face type helmet in which the breath of a user reflected against the chin guard, accumulated between the user and the inner surface of the shell and flowed toward the right and left cheek pads is guided in an efficient manner from the lower part of the helmet in a slant rearward direction and released out of the helmet without affecting the original holding function of the cheek installing members (the cheek pads) contributing to the comfortable fit of the helmet, resulting in the breath not accumulated in the space at the front part of the face of the person wearing the helmet.

The technical means applied by the present invention to accomplish the aforesaid problems has a feature in the full-face type helmet in which the shock absorbing liner is arranged inside the full-face type shell and the cheek installing members (cheek pads) are fixed to both right and left sides in correspondence with the location ranging from the head or the ears to the cheeks of the helmet wearing person, wherein a guide passage for releasing the breath of the helmet wearing person reflected at the chin guard installed inside the shell and accumulated between the helmet wearing person and the inner surface of the shell from the lower part of the shell in a slant rearward direction is formed by crushing and deforming the intermediate part of the cushion member constituting the cheek pads in a thickness direction or cutting the cushion member without reducing the abutted area with the cheeks in the cheek pads and the cheek holding function.

The formation of the guide passage at the cheek pads is carried out by a method wherein the front lower side of the cushion member laminated and adhered on the base member constituting the cheek pads is made non-adhered in respect to the base member, an outer cover covering the base member and the cushion member are applied with a certain tension being set to the cushion member at the non-adhered part of the cushion member and engaged with the base member.

As a method for applying a tension to this outer cover, the outer cover is formed into a bag shape, a rubber ring having a sufficient extending or shrinkage is fixed to an opening of the cover, and the tension is applied by the extending or shrinkage force. In this case, the part in the outer cover corresponding to that location (the front lower part) is formed with an opening to which the corner part at the front lower side of the base member is fitted. In addition, in order to apply a certain tension effectively against the corresponding portion of the outer cover, there may be applied a hook for use in engaging with the outer cover against the predetermined location of the base member and the hook may be integrally formed with the base member or the separate molded product may be adhered to and fixed to the base member.

In the case that the guide passage is formed with a certain tension being applied to the front lower portion of the outer cover, the corresponding part of the cushion member can be peeled of f from its extremity end toward an inner part in order to form a neat guide passage and in this case, when the repelling force of the cheek pads is reduced by the peeling-off of the cushion member, a reinforcing plate such as a synthetic resin plate having a less amount of extending or shrinkage is adhered to the peeled-off portion of the cushion member so as to adapt for a shrinkage or a warping of the cushion member.

In addition to the method in which a certain tension is applied to the outer cover for covering the base member and the cushion member to form the guide passage, the guide passage may also be formed between the base member and the curved molded plate such that the non-adhered part of the front and lower portion of the cushion member in the cheek pads with the base member is provided with a soft curved molded plate so as to cause the cushion member to be crushed and deformed but the plate having sufficient elasticity so as not to injure the user and its part is adhered to and fixed to the base member.

The guide passage in the cheek pads may be formed such that the cap integrally provided with the molded plate to be abutted against the non-adhered portion of the cushion member and pushing it up from the base member in a direction moving away from the base member is applied to cover the cushion member at the front lower parts of the cheek pads to be removably attached to the shell and the base member at the non-adhered location of the base member. In this case, it may also be applicable that the cap provided with the molded plate is applied from above the outer cover and crushed together with the cover and the outer cover may be applied to the base member before the outer cover is set so as to crush the cushion member and then the outer cover may be applied over it. Provided that in this case, the corresponding location of the outer cover is provided with an opening through which the cap may pass.

Although the means for forming the guide passage is effective for the system pad in which the cheek pads are removably installed in respect to the shell, the guide passage in the present invention may also be utilized in a fixed type in which the cushion member for pressing from the cheek portions to the chin portion is adhered to and fixed to the integral right and left shock absorbing liners made of expanded polystine stylofoam or the like.

The means for forming the guide passage which is effective for the fixed type is made such that a soft plate having a less amount of extending or shrinkage is sawn to the cushion member in the cheek installing members and the cover for covering the shock absorbing liner to which the cushion member is laminated and adhered, this is covered by the cover and the cushion member at the front and lower portion of the cheek installing members is crushed by the molded plate so as to define and form the guide passage.

In accordance with the aforesaid means, the guide passage extending in a slant rearward direction is formed at the front and lower portion of the cheek pads or the cheek installing members by crushing or deforming the intermediate part of the cushion member in a thickness direction at the cheek installing members laminated on and fixed to the inner side of the cheek pads or the shock absorbing liner in the shell which are removably arranged at right and left portions in the shell or by cutting the cushion member, thereby the breath of the person wearing the helmet being reflected at the chin guard part, accumulated between the person and the inner surface of the shell and flowed toward the cheek pads or the cheek installing members is guided by the guide passage from the lower portion of the helmet in a slant rearward direction and discharged. Accordingly, the breath of the helmet wearing person is not accumulated in the space at the front part of the face in the helmet.

In addition, the guide passage is formed by crushing or deforming or peeling off the intermediate part of the cushion member in its thickness direction, so that the abutted area of the cushion member ranging from the cheeks to the chin (mouth part) of the user and the cheek holding function are not changed from those of the prior art, resulting in that the comfortable fit is not detrimentally affected.

DESCRIPTION OF THE PREFERRED EMBODIMENTS

Figure 1:
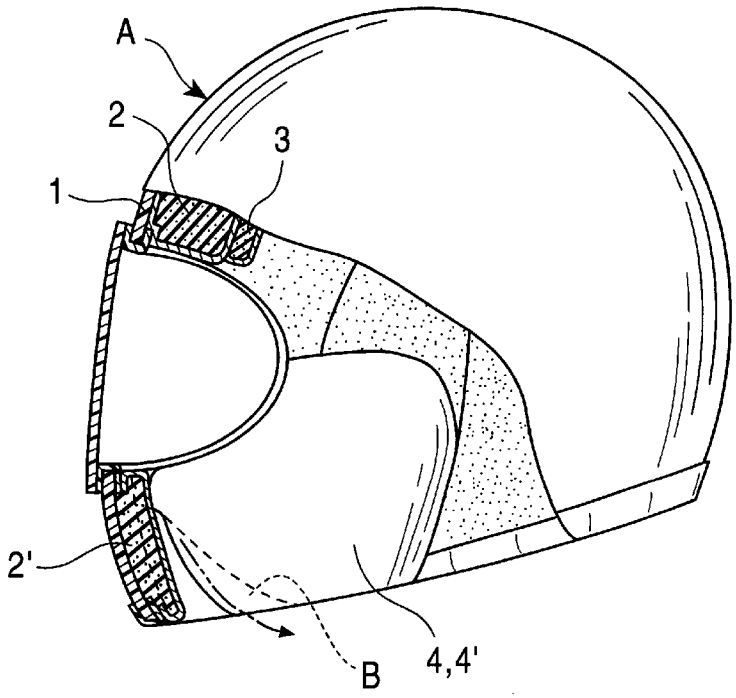
FIG. 1 is a side elevational view with a part being broken away of one preferred embodiment of a full-face type helmet of the present invention.

Referring now to the drawings, some preferred embodiments of the present invention will be described.

Figure 2:
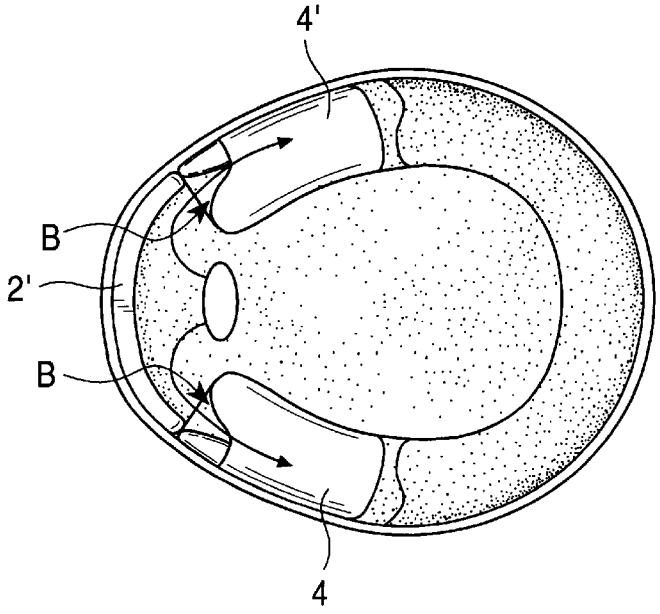
FIG. 2 is a bottom view of FIG. 1.
Figure 3:
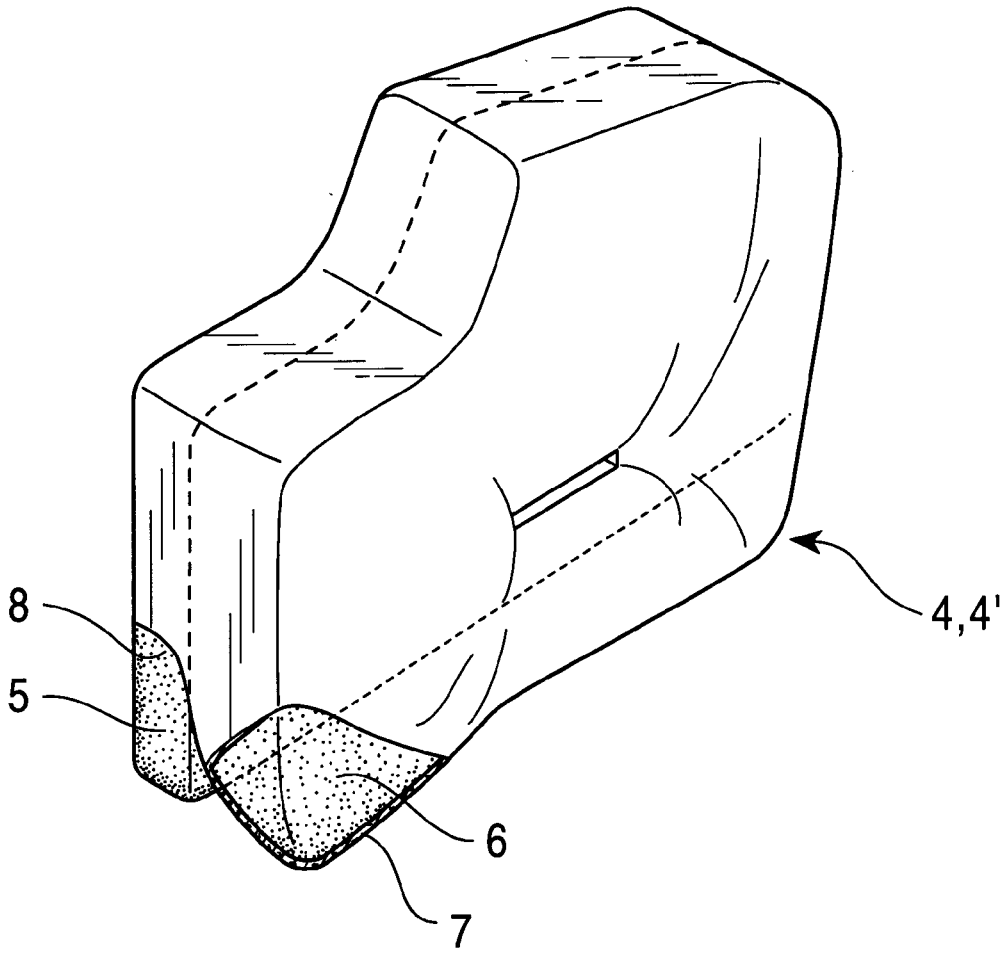
FIG. 3 is a perspective view with a part cut away of a preferred embodiment according to first aspect of the present invention.

FIGS. 1 and 2 illustrate a full-face type helmet A provided with a cheek pad in which cheek installing members arranged at both right and left sides in a shell are removably installed in respect to the shell, wherein reference numeral 1 denotes a shell having a well-known shape and made of fiber reinforced resin such that the head of a user may be well fitted in the shell. A shock absorbing liner 2 made of expanded polystyrene foam, or a material having the same or more shock absorbing performance as that of expanded polystyrene foam, is formed along an inside part of the shell including the top of the head and is fitted and fixed to the inside part of the shell 1. A chin guard 2' is fitted and fixed to a segment ranging from the chin part at the lower section of the shell 1 to locations before the right and left cheeks, and at the same time an installing member 3 is fixed to the inside surface of the shock absorbing liner 2.

The chin guard 2' is made of expanded polystyrene foam, or a material having the same or more shock absorbing performance as that of expanded polystyrene foam, and is formed to cover a segment ranging from the chin part within the shell 1 to locations before the right and left cheeks, and at the same time its surface part contacted with the chin part is adhered with surface materials such as leather, synthetic leather or the like.

The shock absorbing liner 2 and the chin guard 2' are fitted inside the shell 1 and they are integrally connected and fixed to each other by an adhesive, thereby concave segments having cheek pads 4, 4' fitted and installed therein are defined and formed between the shock absorbing liner 2 and the chin guard 2'.

The cheek pads 4, 4' are composed of a base member 5 (made of material similar to that of the shock absorbing liner) having a shock absorbing performance like expanded polystyrene foam, a cushion member 6 made of urethane or the like laminated and adhered to an inside part of the base member 5, and an outer cover 7 for covering the base member 5 and the cushion member 6, wherein the front end and the rear end of the cheek pads 4, 4' are provided with an engaging means (not shown) removably engaging with and holding the cheek pads between the shock absorbing liner 2 and the chin guard 2'.

The cushion member 6 constituting the cheek pads 4, 4' is made such that its front lower part (a substantial triangular corner part including a lower corner section) near the mouth of a user is not adhered against the base member 5 and other remaining portions are adhered and fixed to it to make an integral assembly of the base member 5 and the cushion member 6 and at the same time its location covering the front lower part in the outer cover 7 is provided with a through-pass hole 8 to which the corner part of the base member 5 is fitted. The outer cover 7 is applied to the base member 5 with a tension force applied toward the center of the base member 5, thereby at the through-pass hole 8 a tension force is applied in its vertical line direction with the result that the non-adhered portion of the cushion member 6 is crushed and deformed and then a substantial triangular cone shaped guide passage B is formed between the inner surface of the cushion member 6 abutting against the cheeks and the chin and the base member 5.

That is, the guide passage B is defined and formed from the front lower part of the cheek pads 4, 4' toward the rear lower portions of them.

Figure 4:
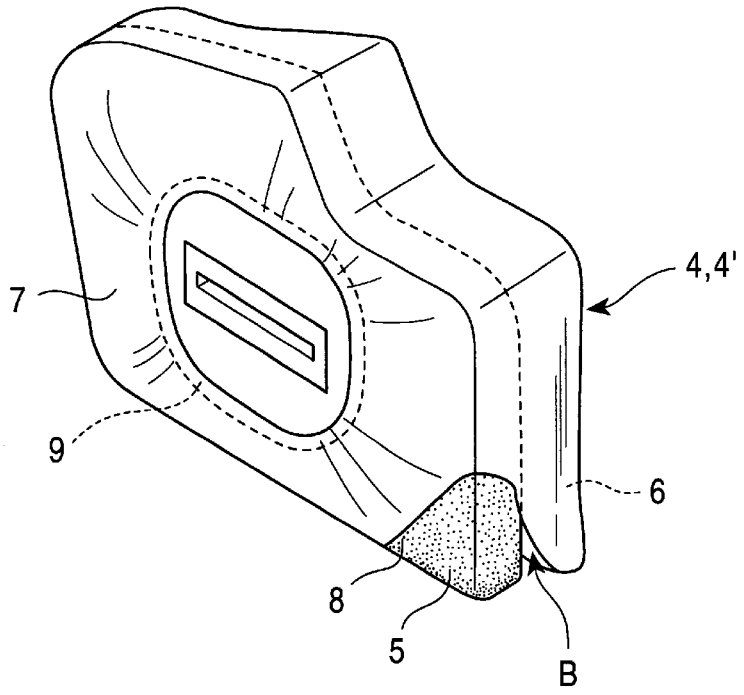
FIG. 4 is a perspective view of a cheek pad shown in FIG. 3 as seen from its opposite side.

As a method for applying a tension to the outer cover 7, a rubber ring 9 having a sufficient extending or shrinking characteristic is fixed to the opening of the outer cover 7 formed into a bag shape as shown in FIG. 4 and then a tension is applied by a shrinking force of this rubber ring 9.

Figure 5:
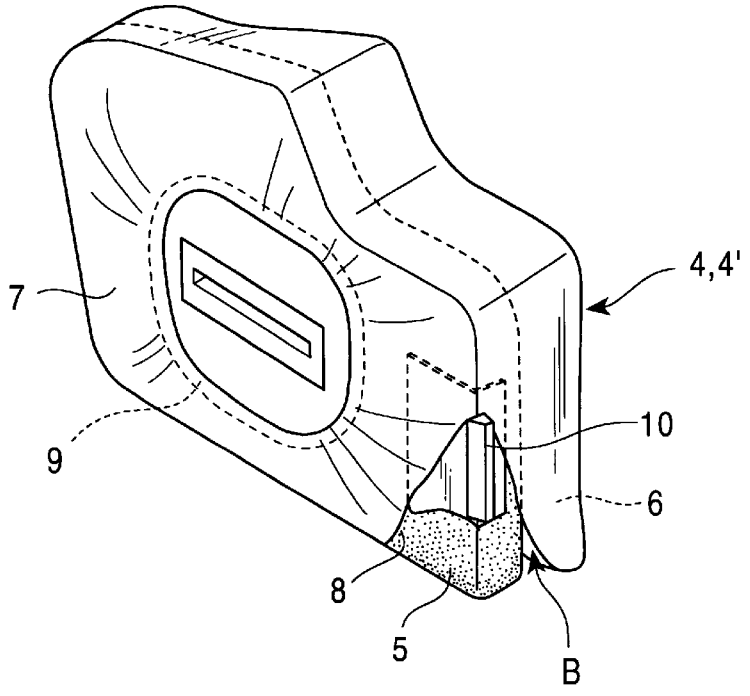
FIG. 5 is also a perspective view of an example of modification of the preferred embodiment according to first aspect of the present invention.

In addition, in the case that a tension is effectively applied to the corresponding location in the outer cover 7, the predetermined location of the base member 5 is provided with a hook 10 to which the outer cover 7 is engaged as shown in FIG. 5, thereby the tension applied in the aforesaid direction is increased.

Figure 6:
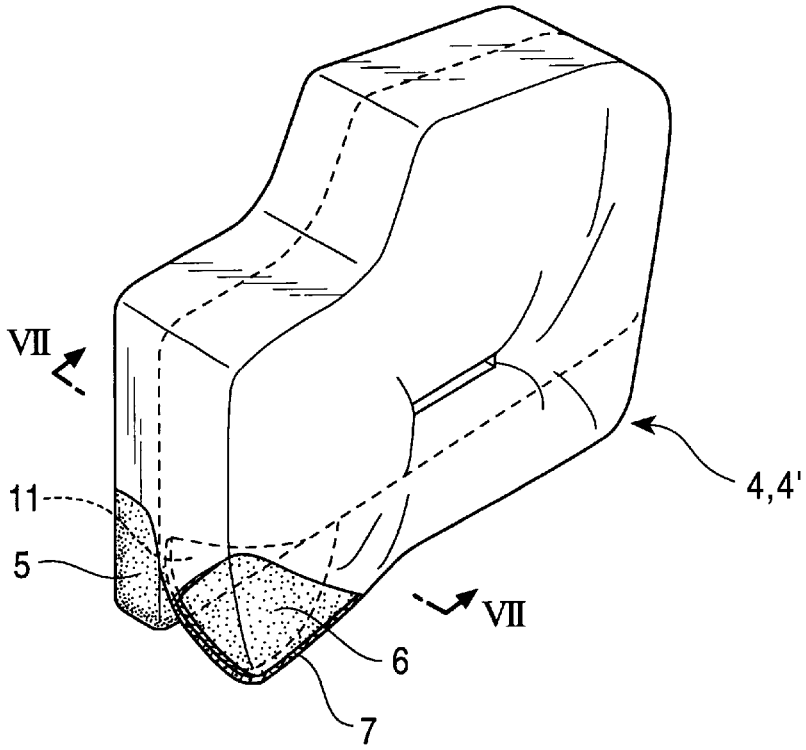
FIG. 6 is a perspective view with a part being cut away for showing a still further example of modification of the preferred embodiment according to first aspect of the present invention.
Figure 7:
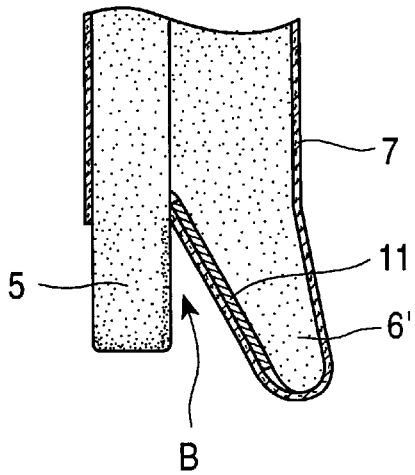
FIG. 7 is an enlarged sectional view taken at a substantial part shown in FIG. 6.

In addition, in the case that a tension is applied to the front lower part in the outer cover 7 to form the guide passage B, and further in the case that the guide passage B is formed in an acute angle-shaped manner, the corresponding portion of the cushion member 6 may be peeled off from its leading end to its inner side and in this case, if the part of the cushion member 6 in its thickness direction is peeled off to cause a repelling force of the chin pad itself is decreased, a reinforcing plate 11 such as a synthetic resin plate having a less amount of extending or shrinking characteristic is adhered to and fixed to the peeled-off portion as shown in FIGS. 6 and 7 so as to adapt for shrinkage and warping of the cushion member 6, thereby the function of the cheek pads to push against the chin and the cheeks can be maintained.

Figure 8:
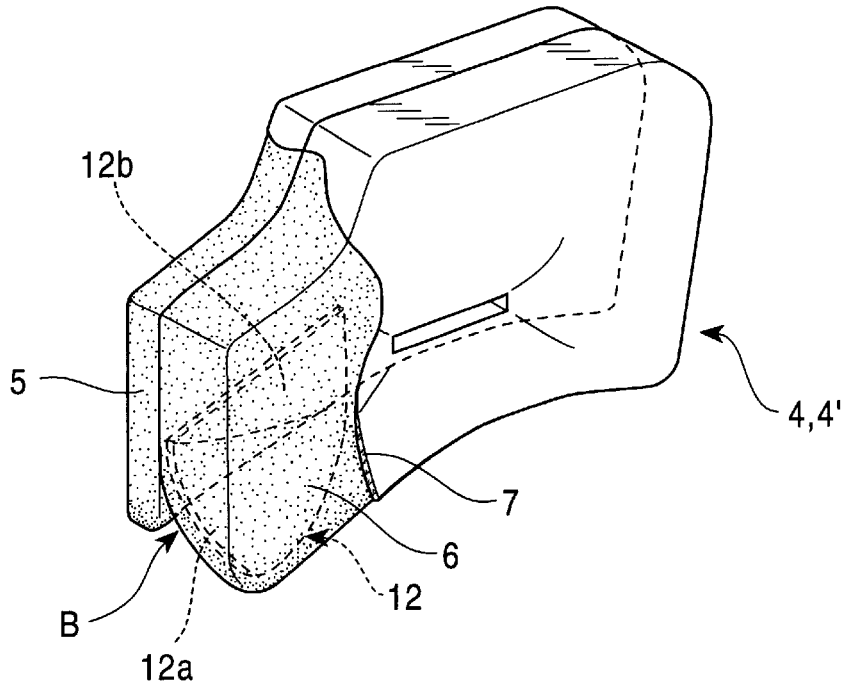
FIG. 8 is a perspective view with a part being cut away to show a preferred embodiment according to third aspect of the present invention.
Figure 9:
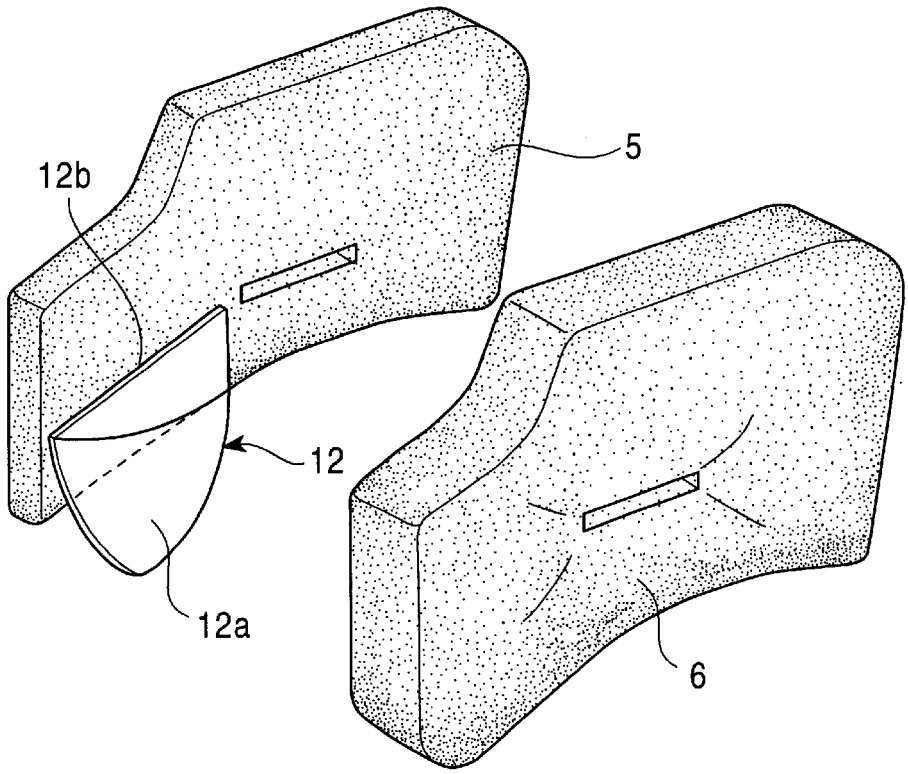
FIG. 9 is an exploded perspective view for showing a relation of a base member, a cushion member and a curved shape molding plate before the cheek pad shown in FIG. 8 is completed.

Although the aforesaid preferred embodiment is an example in which a certain tension is applied to the outer cover constituting the cheek pads to form the guide passage B at the front lower portions of the cheek pads, FIGS. 8 and 9 illustrate one example in which the guide passage B is formed without applying any tension to the outer cover.

Its configuration is formed such that a soft curved molded plate 12 having a certain elasticity is arranged at the non-adhered portions in the cheek pads 4, 4' with the base member 5 at the front lower part of the cushion member 6, its partial surface 12*b* is adhered to and fixed to the base member 5 and then the non-adhered portion of the cushion member 6 is pushed up in such a direction as one to be moved away from the base member 5 at the location where the curved molded plate 12 is sprung up, thereby the guide passage B is formed.

Figure 10:
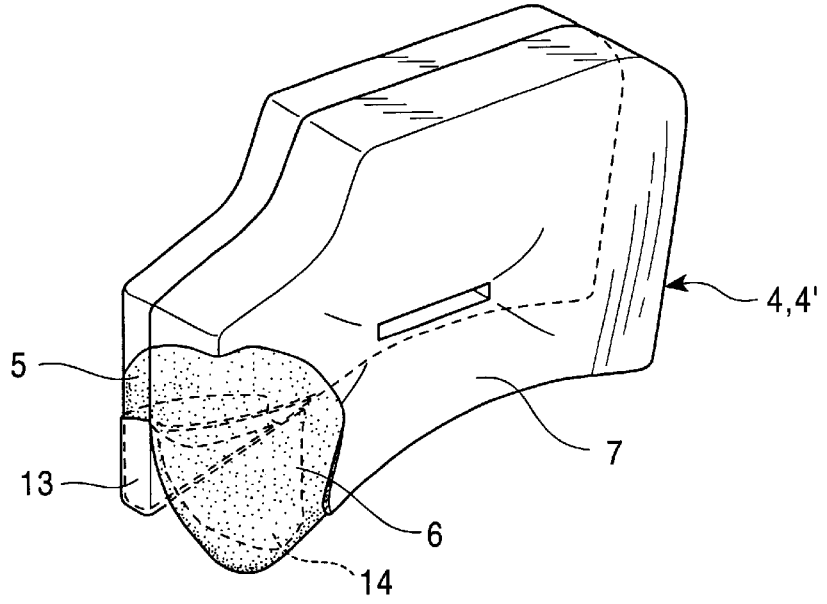
FIG. 10 is a perspective view with a part being cut away for showing a preferred embodiment according to fourth aspect of the present invention.
Figure 11:
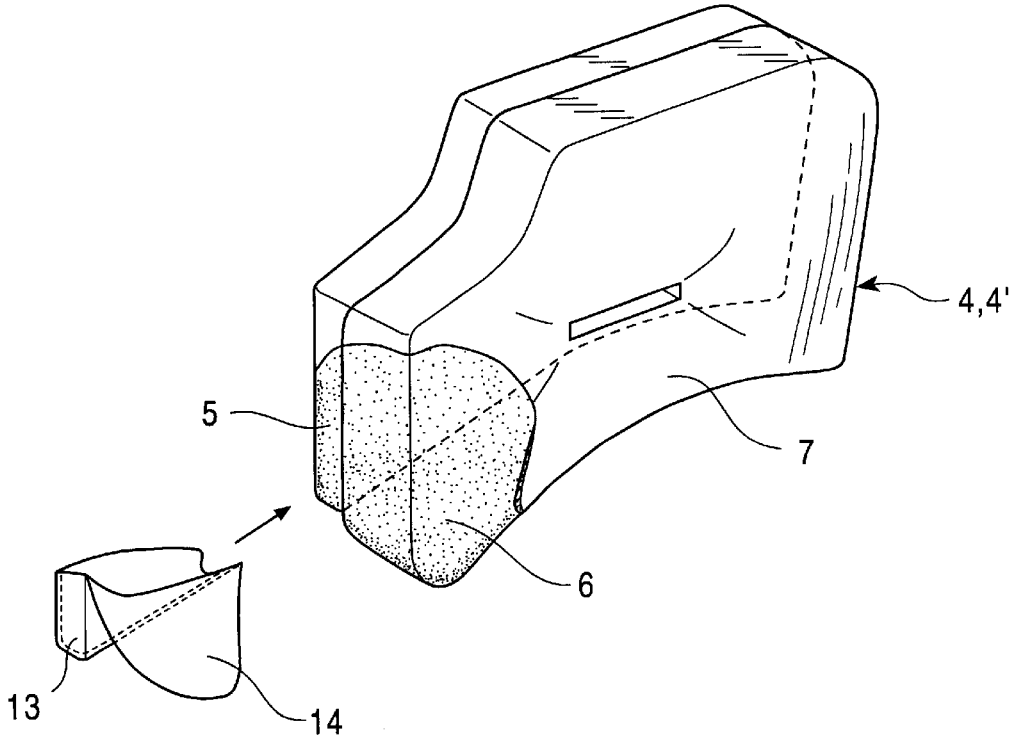
FIG. 11 is also a perspective view for showing a state before a cap in FIG. 10 is applied.

In addition, FIGS. 10 and 11 illustrate another example in which the guide passage B is formed without being dependent on the tension force of the outer cover 7, wherein its configuration is constructed such that a cap 13 made of synthetic resin integrally provided with the molded plate 14 abutted against the non-adhered part of the cushion member 6 to cause the non-adhered part of the cushion member to be forcedly pushed up in such a direction as one to be moved away from the base member 5 is applied to cover the base member 5 at the non-adhered locations of the cushion member 6 and the base member 5 in the cheek pads. In this case, although it is applicable that the cap 13 provided with the molded plate 14 is applied from above the outer cover 7 to the corner part at the front lower portion of the base member 5 and it may be crushed together with the cover, it is also applicable that before the outer cover 7 is applied, it is applied to the base member to cause the corresponding portion of the cushion member 6 to be forcedly pushed up away from the base member with the molded plate and the outer cover 7 is applied over the corresponding portion, wherein in this case, the corresponding location of the outer cover 7 is provided with an opening into which the corner part of the front lower portion of the base member 5 covered with the cap 13 is fitted. The cap 13 in this case is of a soft synthetic resin molded product so as to push up the cushion member 6 but have a sufficient elasticity so as to apply no damage to a person wearing this helmet.

Each of the aforesaid preferred embodiments has been described in reference to a system pad in which the cheek installing members are removably set in the shell. However, the guide passage formed at the cheek installing members in the present invention can be employed in a fixed type in which it is adhered to and fixed to the right and left integral type chin guards 2' with the cushion member pushing against the chin part being formed of expanded polystyrene foam or the like.

Figure 12:
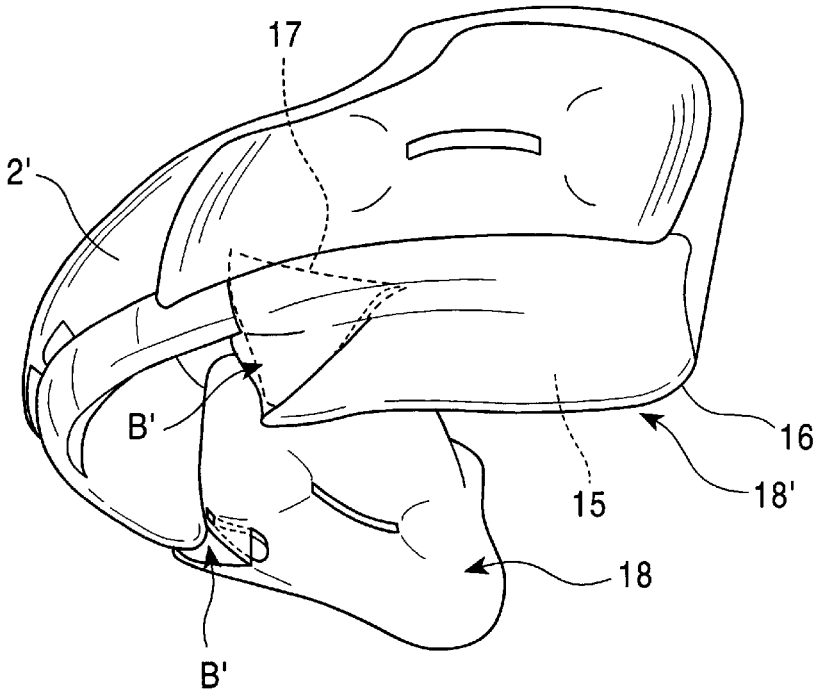
FIG. 12 is a perspective view for showing a preferred embodiment according to second aspect of the present invention.
Figure 13:
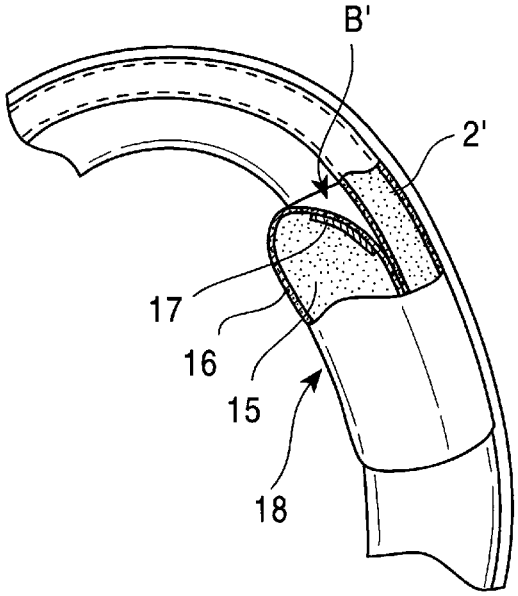
FIG. 13 is also a bottom view with a part being cut away.

Referring to FIGS. 12 and 13, another preferred embodiment is described wherein the cheek installing members 18, 18' are constructed such that a cushion member 15 is laminated and adhered to the right and left inner predetermined locations of the chin guard 2' formed by expanded polystine stylofoam into a substantial U-shape as seen in its top plan view, the cushion member 15 and the chin guard 2' are formed to be covered by the cover 16, the front lower part in the cushion member 15 is not adhered to the chin guard 2', a soft molded plate 17 having a certain elasticity is sawn to the inner surface of the cover 16 corresponding to the non-adhered portion of the cushion member 15, it is covered by the cover 16, thereby the front lower parts of the cheek installing members 18, 18' at the cushion member 15 are crushed by the molded plate 17 and then a substantial V-shaped guide passage B' is defined and formed.

With such an arrangement as above, since the cheek pads 4, 4' (or the cheek installing members 18, 18') are formed, at their front lower portions, with either the guide passage B or B' directed in slant rearward and downward direction, breath of the wearing person flowing toward the cheek pads 4, 4' (or the cheek installing members 18, 18') arranged at both rear right and left sides of the chin guard passes through either the guide passage B or B' and is discharged from the lower portion of the helmet out of the helmet. Accordingly, the breath of the helmet wearing person is not accumulated at the helmet space in front of the face of the wearing person, resulting in that the inner surface of the shield arranged at the front surface of the helmet is prevented from collecting moisture.

In addition, since the guide passage is made by a crush deformation or a cutting of the intermediate part of the cheek pad or the cushion member for the cheek installing members in its thickness direction and its surface area abutting against the cheeks and the chin is kept as it is, the original function to hold the cheeks and the chin provided by the cheek pads or the cheek installing members is not damaged at all and a comfortable wearing feeling of the helmet can be assured.

Means for forming the guide passage in the cheek installing member (the cheek pad) in the present invention other than means for applying the cap having the molded plate to the base member to form the guide passage can be employed to both the system pad in which the cheek installing members (the cheek pads) are removably set in respect to the shell and the type in which the cheek installing members are fixed to the shell.

In the full-face type helmet according to the first, second, third and fourth aspects of the present invention, it is possible to pass the breath of the user flowing toward the cheek pads arranged at both rear right and left sides of the chin guard or toward the cheek installing members through the guide passage and discharge it out of the helmet from its lower part. Accordingly, the breath of the user is prevented from being accumulated in the space at the front part of the face in the helmet, resulting in preventing the inner surface of the shield arranged at the front surface of the helmet from collecting moisture with the breath of the user.

In addition, since the guide passage is formed by a crush deformation or a cutting of the intermediate part of the cheek pads or the cushion member for the cheek installing members in its thickness direction and the surface area abutting against the cheeks and the chin is kept as it is, the original function of holding the cheeks and the chin provided by the cheek pads or the cheek installing members is not detrimentally affected and a comfortable fit can be assured.

In addition, the aforesaid effect can be accomplished by a quite simple structure under the configuration according to first aspect of the present invention.

Further, the configuration according to second, third and fourth aspects of the present invention enables the crush deformation and pushing-up of the cushion member to be carried out effectively and then the guide passage can be formed in an acute angle contoured manner.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A full-face helmet which comprises a full face shell, a shock absorbing liner in the shell, and cheek pads fixed at both right and left sides inside the shell in correspondence with the shock absorbing liner, wherein said cheek pads each comprise a base member and a cushion member which are laminated and adhered together except for a front lower portion where said cushion member is not adhered to said base member, each of said cheek pads including an outer cover which at least partly covers said base member and said cushion member and is tensioned to space a non-adhered portion of said cushion member from said base member, thereby providing a guide passage for releasing breath of a user reflected by a chin guard arranged inside the shell and accumulated between the user and the inner surface of the shell from a lower part of the shell in a slant rearward direction without reducing an abutted area at said cheek pads against the user's cheeks or a reduction in cheek holding function.

2. A full-face helmet which comprises a full face shell, a shock absorbing liner in the shell, and cheek pads fixed at both right and left sides inside the shell in correspondence with the shock absorbing liner, wherein said cheek pads each comprise a base member and a cushion member which are laminated and adhered together except for a front lower portion where said cushion member is not adhered to said base member, and an outer cover, each of said cheek pads including a soft plate member having a reduced amount of extending or shrinkage fixed inside said outer cover corresponding to the non-adhered portion of the cushion member so that the front lower portion of said cushion member is spaced from the base member, the outer cover being fixed to the base member with the non-adhered portion of the cushion member being crushed and deformed by said plate member, thereby forming a guide passage for releasing breath of a user reflected by a chin guard arranged inside the shell and accumulated between the user and the inner surface of the shell from the lower portion of the shell in a slant rearward direction without reducing an abutted area at said cheek pads against the user's cheeks or a reduction in cheek holding function.

3. A full-face helmet which comprises a full face shell, a shock absorbing liner in the shell, and cheek pads fixed at both right and left sides inside the shell in correspondence with the shock absorbing liner, wherein said cheek pads each comprise a base member and a cushion member which are laminated and adhered together except for a front lower portion where said cushion member is not adhered to said base member, a soft curved molded plate having a relatively high elasticity is arranged at the non-adhered location of the front lower portion of the cushion member with the base member, a part of which is adhered to and fixed to the base member, the front lower part of said cushion member being set away from the base member, thereby forming a guide passage for releasing breath of a user reflected by a chin guard arranged inside the shell and accumulated between the user and the inner surface of the shell from the lower portion of the shell in a slant rearward direction without reducing an abutted area at said cheek pads against the user's cheeks or a reduction in cheek holding function.

4. A full-face helmet which comprises a full face shell, a shock absorbing liner in the shell, and cheek pads removably attached at both right and left sides inside the full-face shell in correspondence with the shock absorbing liner, wherein said cheek pads each comprise a base member and a cushion member which are laminated and adhered together, a front lower portion of the cushion member is not adhered to said base member, a cap integrally provided with a molded plate abutted against the non-adhered portion of the cushion member, the cushion member being pushed up in a direction moving away from the base member by the plate, said cap applied to the base member at a location to space the front lower portion of said cushion member from the base member, thereby providing a guide passage for releasing breath of a user reflected by a chin guard arranged inside the shell and accumulated between the user and the inner surface of the shell from the lower portion of the shell in a slant rearward direction without reducing an abutted area at said cheek pads against the user's cheeks or a reduction in cheek holding function.

* * * * *